US009500002B2

(12) United States Patent
Bailey et al.

(10) Patent No.: US 9,500,002 B2
(45) Date of Patent: Nov. 22, 2016

(54) DOOR HANDLE ASSEMBLY

(71) Applicant: Magna Closures Inc., Newmarket (CA)

(72) Inventors: Steve Bailey, London (CA); John Cunningham, Strathroy (CA)

(73) Assignee: Magna Closures Inc., Newmarket (CA)

( * ) Notice: Subject to any disclaimer, the term of this patent is extended or adjusted under 35 U.S.C. 154(b) by 7 days.

(21) Appl. No.: 14/271,716

(22) Filed: May 7, 2014

(65) Prior Publication Data

US 2014/0239652 A1 Aug. 28, 2014

Related U.S. Application Data

(60) Continuation of application No. 13/335,856, filed on Dec. 22, 2011, now Pat. No. 8,746,759, which is a division of application No. 11/778,830, filed on Jul. 17, 2007, now abandoned.

(60) Provisional application No. 60/831,897, filed on Jul. 18, 2006.

(51) Int. Cl.

| | |
|---|---|
| ***E05B 3/00*** | (2006.01) |
| ***E05B 3/02*** | (2006.01) |
| ***E05B 85/12*** | (2014.01) |
| *E05B 79/06* | (2014.01) |

(52) U.S. Cl.

CPC ..... *E05B 3/02* (2013.01); *E05B 85/12* (2013.01); *E05B 79/06* (2013.01); *Y10T 29/49863* (2015.01); *Y10T 292/57* (2015.04)

(58) Field of Classification Search

CPC ..... E05B 3/02; E05B 3/04; E05B 85/12; E05B 85/14; E05B 85/16; E05B 79/06

USPC ..... 292/113, 336.3, 347, 348, 350, 352, 292/DIG. 31, DIG. 38, DIG. 61, DIG. 64

See application file for complete search history.

(56) References Cited

U.S. PATENT DOCUMENTS

| | | | |
|---|---|---|---|
| 3,424,510 | A | 1/1969 | Moon |
| 3,471,874 | A | 10/1969 | Dixon |
| 4,038,718 | A | 8/1977 | Reilhac et al. |
| 4,993,763 | A | 2/1991 | Tanimoto et al. |
| 5,263,750 | A | 11/1993 | Smith et al. |
| 5,895,081 | A | 4/1999 | Tanimoto et al. |
| 6,036,244 | A | 3/2000 | Tyves et al. |
| 6,167,779 | B1 | 1/2001 | Sano et al. |
| 6,264,254 | B1 | 7/2001 | Siegfried et al. |
| 6,460,904 | B1 | 10/2002 | Stapf |
| 6,460,905 | B2 | 10/2002 | Suss |
| 6,976,717 | B2 | 12/2005 | Barr et al. |
| 6,988,752 | B2 | 1/2006 | Belchine et al. |
| 7,104,575 | B2 | 9/2006 | Kakita |
| 2005/0146147 | A1 | 7/2005 | Niskanen et al. |

*Primary Examiner* — Alyson M Merlino
(74) *Attorney, Agent, or Firm* — Dickinson Wright PLLC

(57) ABSTRACT

A handle assembly for a vehicle door includes a backplate, operable to be mounted to a portion of the vehicle door, and the backplate including a recessed region displaced away from the exterior surface of the vehicle door. A handle aperture is provided within the recessed region of the backplate with at least one pin mount extending from the recessed region of the backplate. The pin mount includes a void and a slot that is narrower than the void. Pins extend from a handle body portion into the voids and pivotally mount the handle to the backplate. The handle further includes a spring locator retaining a handle spring prior to mounting the handle to the backplate. The spring is compressed between the handle and the backplate and biases the handle to an un-actuated position.

18 Claims, 6 Drawing Sheets

DOOR HANDLE ASSEMBLY

CROSS-REFERENCE TO RELATED APPLICATIONS

This Continuation application claims the benefit of U.S. Divisional patent application Ser. No. 13/335,856, filed Dec. 22, 2011, which claims the benefit of U.S. Utility patent application Ser. No. 11/778,830, filed Jul. 17, 2007, which claims the benefit of U.S. Provisional Application No. 60/831,897, filed Jul. 18, 2006, the entire disclosures of which are considered part of the disclosure of this application and hereby incorporated by reference in their entirety.

FIELD OF THE INVENTION

The present invention relates to vehicles doors. More specifically, the present invention relates to a handle assembly used to actuate the latch of a vehicle door.

BACKGROUND OF THE INVENTION

Automotive manufactures are looking to reduce the cost of vehicle components. One way to reduce costs is to reduce the number of parts used in a component, simplifying both component assembly and supply chain management. Another way is to engineer the component so that it can be assembled more quickly and without expensive equipment. For example, U.S. Pat. No. 6,039,366 to Lewis teaches a handle assembly that includes an escutcheon plate sized to fit in the door aperture; a handle pivotally mounted on the escutcheon plate via an axial pin; a threaded fastener device secured to the escutcheon plate and extending inwardly; and a clip of U-configuration. Once the door handle assembly has been installed in the aperture of a vehicle door skin, the door handle assembly may be mounted simply by tightening the threaded fastener.

U.S. Pat. No. 6,052,948 to Spitzley teaches a method of mounting a motor vehicle door handle assembly on a skin of a door assembly where the handle assembly includes a handle member and a base plate defining a planar surface. A plurality of individual, spaced lug apertures and a separate spaced clip aperture are provided in the door skin. Lugs are provided on the handle base plate, each sized to pass through a respective lug aperture in the door skin to retain the handle assembly on the door skin. The handle includes a depending hook that extends through an aperture in the base plate and is operable to be connected to a cable to actuate a latch.

U.S. Pat. No. 6,059,329 to Spitzley teaches a method of mounting a motor vehicle door handle assembly to a vehicle door consisting of locating a pre-assembled handle assembly within a door skin aperture, and actuating the handle assembly to fixedly mount the handle assembly.

While the above-mentioned patents all describe handle assemblies that can be mounted to a door more quickly, it is still desirable to provide a reduced-cost handle assembly and mounting method.

SUMMARY OF THE INVENTION

According to the present invention there is provided a handle assembly for a vehicle door. The handle assembly comprises a backplate operable to be mounted to a portion of the vehicle door. The backplate includes a recessed region displaced away from an exterior surface of the vehicle door, and a handle aperture within the recessed region of the backplate. A least one pin mount is typically formed along the backplate, the pin mount including a void and a slot that is narrower than the void. A handle is pivotally mounted to the backplate and located at least partially within the recessed region. The handle includes at least one pivot pin disposed in the void for allowing the handle to pivot between an un-actuated and actuated position.

The present invention provides a simple handle assembly for a vehicle door, with reduced number of elements that is economical to produce and at the same time does not limit the function.

BRIEF DESCRIPTION OF THE DRAWINGS

Preferred embodiments of the present invention will now be described, by way of example only, with reference to the attached Figures, wherein.

DETAILED DESCRIPTION

Figure 1A:
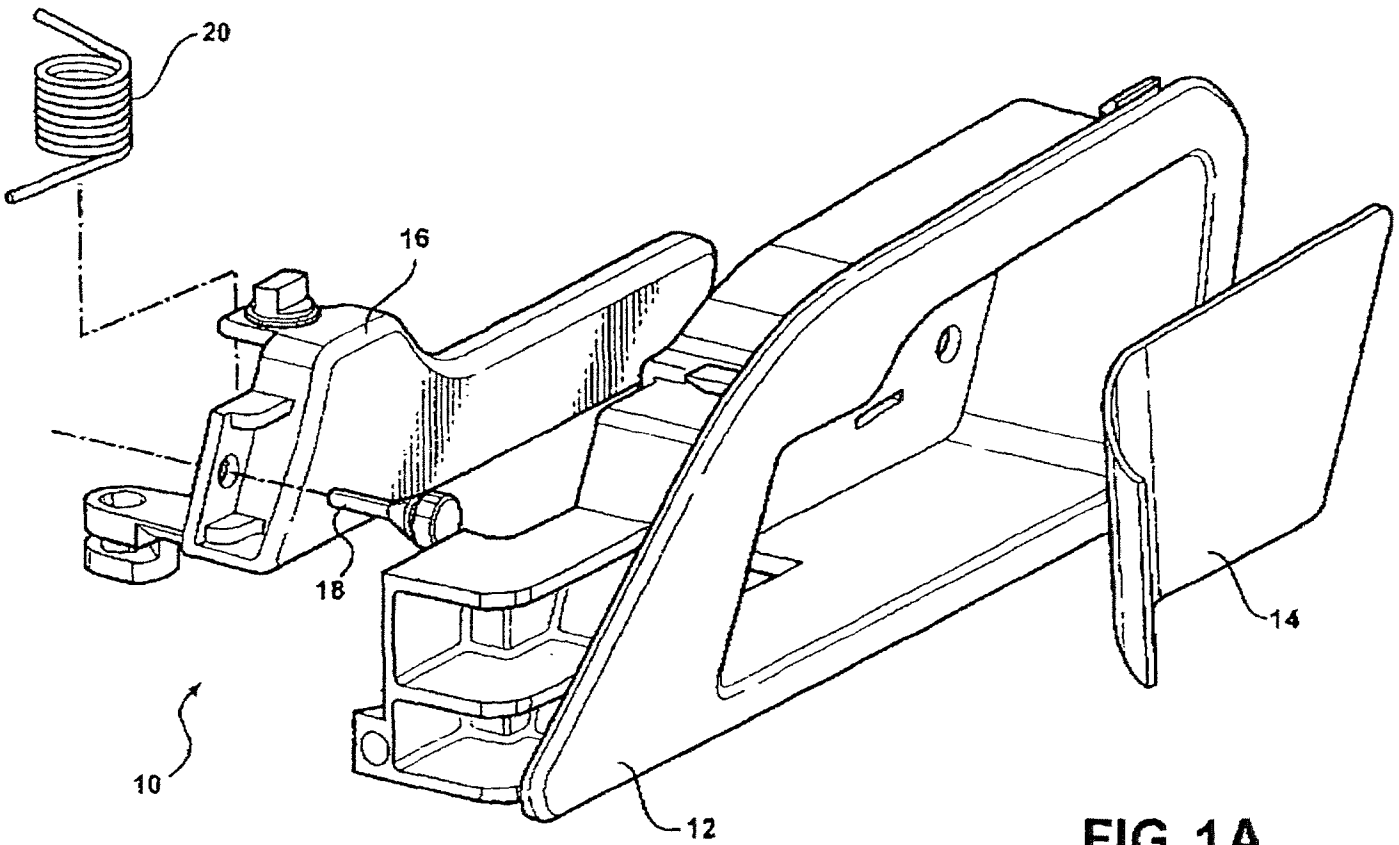
FIGS. 1A and 1B are exploded views of a handle assembly according to a first embodiment of the invention.
Figure 1B:
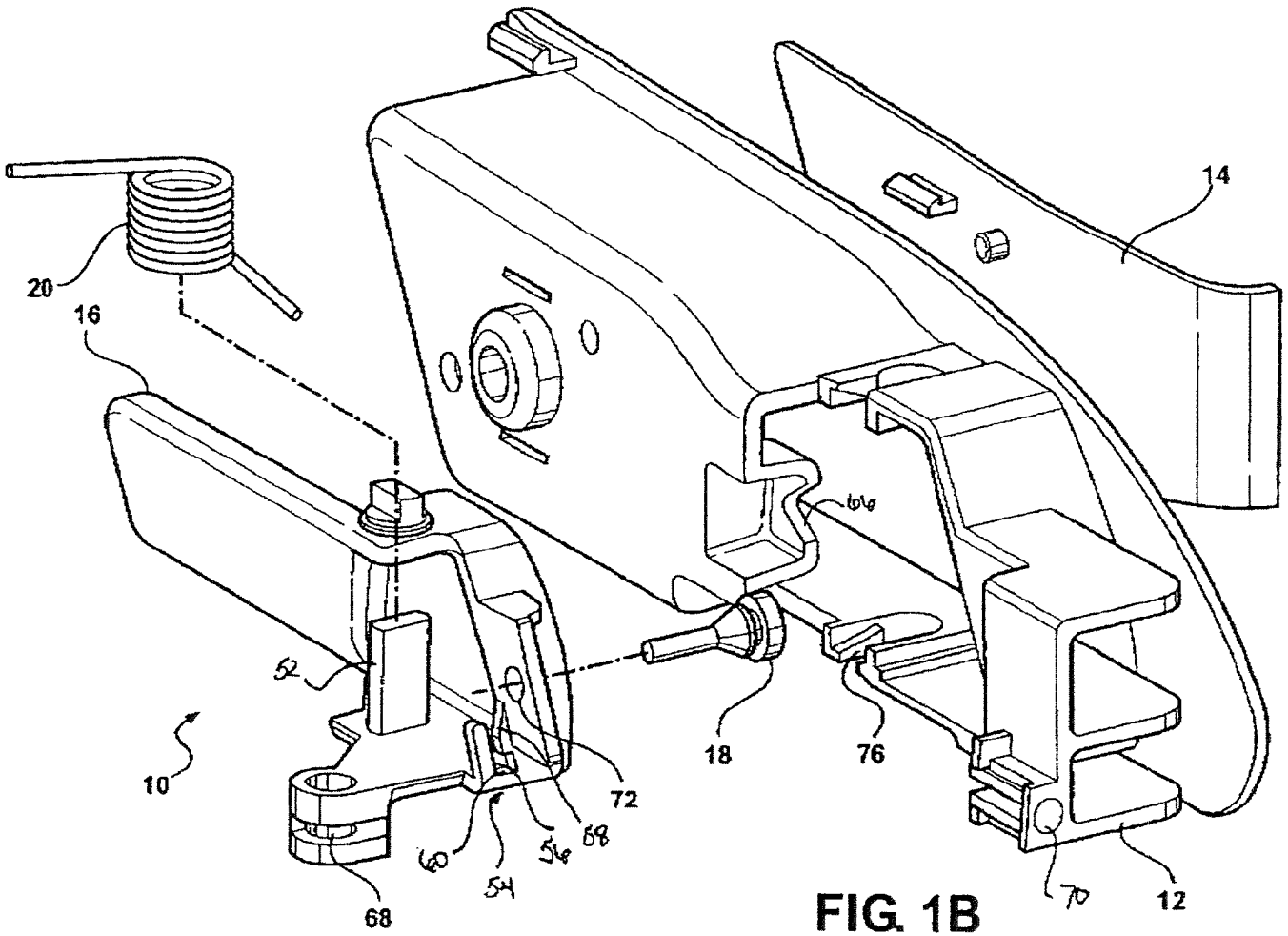

Referring now to FIGS. 1A and 1B, a first embodiment of the invention is shown generally at 10. FIG. 1A shows the "A-side", or exposed side of handle assembly 10, and FIG. 1B shows the "B-side", or concealed side of handle assembly 10. Handle assembly 10 includes a backplate 12, a cover plate 14, a handle 16, a bumper 18, and a torsion spring 20. During assembly, the bumper 18 and the torsion spring 20 are pre-mounted to the handle 16, which is then pivotally mounted to the backplate 12. The mounting of the bumper 18 and the torsion spring 20 are described in greater detail below. Once assembled (FIGS. 2A and 2B), the handle assembly 10 is mountable to an aperture in a vehicle door skin (not shown), and secured to either the door itself or to an internal equipment module (also not shown).

Figure 2A:
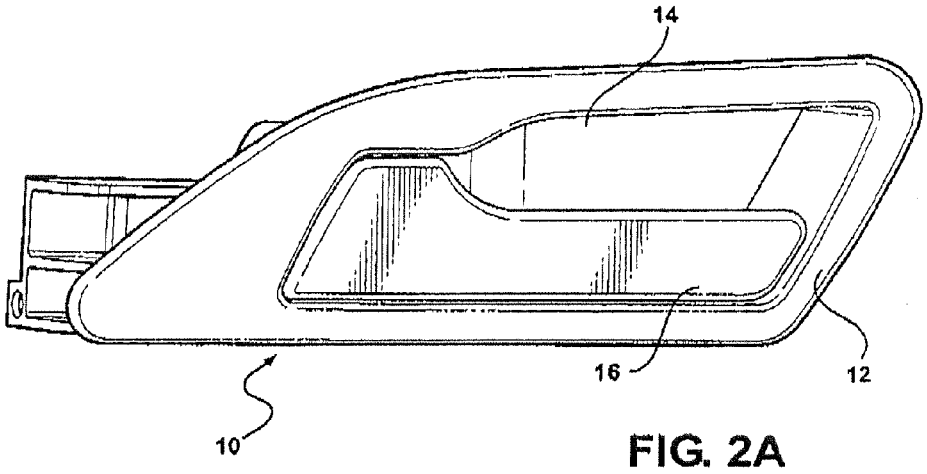
FIGS. 2A and 2B are A-side facing and B-side facing perspective views of the handle assembly shown in FIGS. 1A and 1B.
Figure 2B:
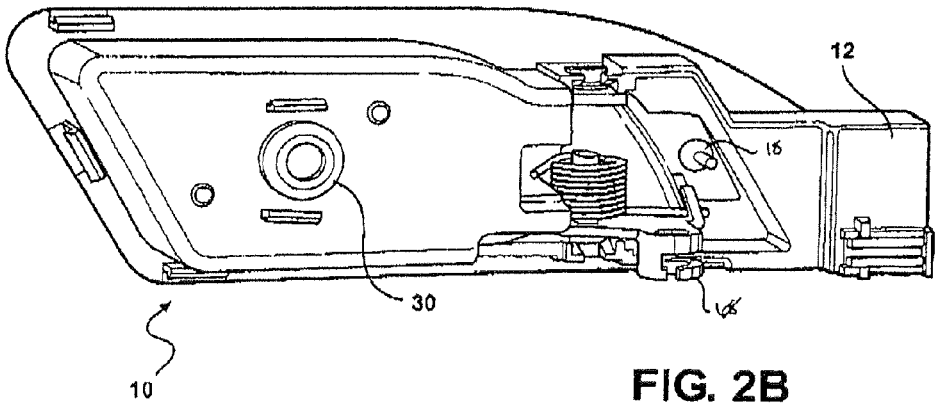
Figure 3:
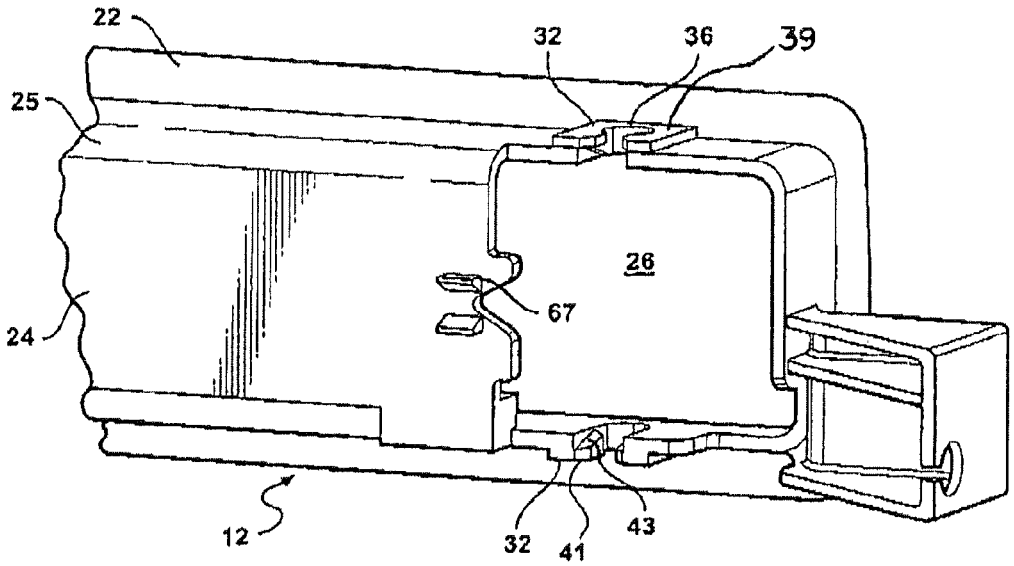
FIG. 3 is a B-side facing perspective view of a portion of a backplate constructed according to an alternative embodiment for the handle assembly shown in FIGS. 1A and 1B.

Referring now to FIG. 3, an alternative embodiment or configuration of backplate 12 is shown and includes a perimeter flange 22 shaped to match the contours of the A-side sheet metal or trim panel of the vehicle door skin, and a concave region 24 that is recessed into the door (relative to the A-side). A web portion 25 interconnects perimeter flange 22 and concave region 24. A handle aperture 26 is provided within concave region 24 to insert handle 16 (described in greater detail below). At least one fastener aperture hole 30 (FIG. 2B) is provided within concave region 24 to locate screws or other such fastener to secure the backplate 12 to the vehicle door. The cover plate 14 is fitted so as to cover a portion of the concave region 24 and to hide the securing fasteners (FIG. 2A).

Figure 7:
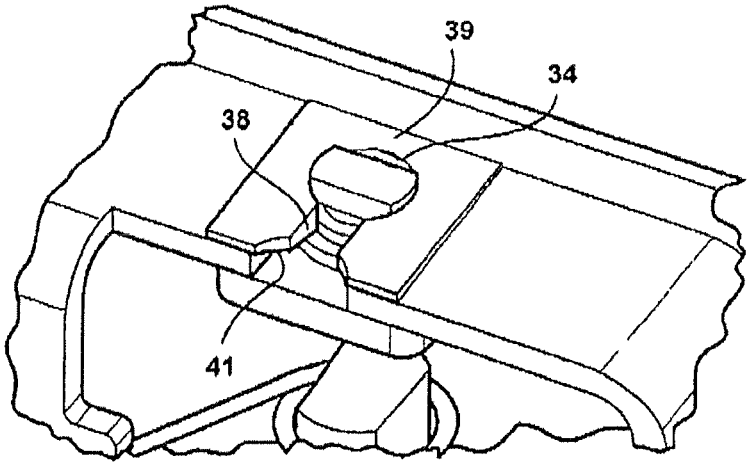

Referring now to FIGS. 3 and 7, a pair of pivot mounts 32 is disposed within the web portion 25 on opposite sides of the handle aperture 26. The two pivot mounts 32 each include a generally cylindrical wall 34 defining a void 36. An assembly slot 38 is provided in the web portion 25 to interconnect the handle aperture 26 with the void 36. A bezel 39 runs along the periphery of cylindrical wall 34. At the mouth of each assembly slot 38 is a curved surface 41 to help locate the handle 16 prior to the insertion of the handle 16 into the pivot mounts 32. Along the sidewalls of the assembly slot 38 is an assembly ramp 43 to ease the snap-in insertion of the handle 16 and to retain the handle 16 relative to the backplate 12 after insertion therein.

Figure 4:
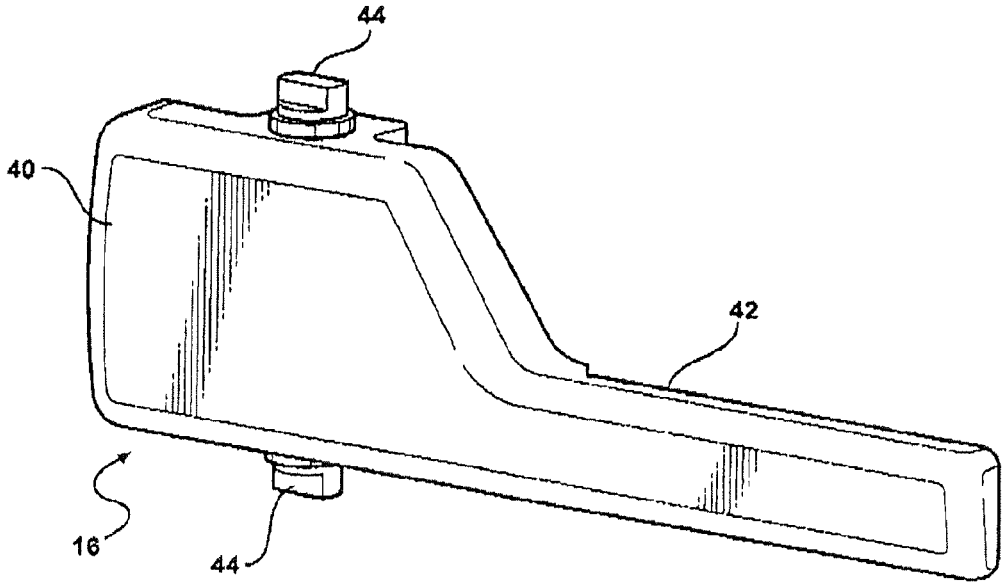
FIG. 4 is an A-side facing perspective view of a handle constructed according to an alternative embodiment for the handle assembly shown in FIGS. 1A and 1B.
Figure 5:
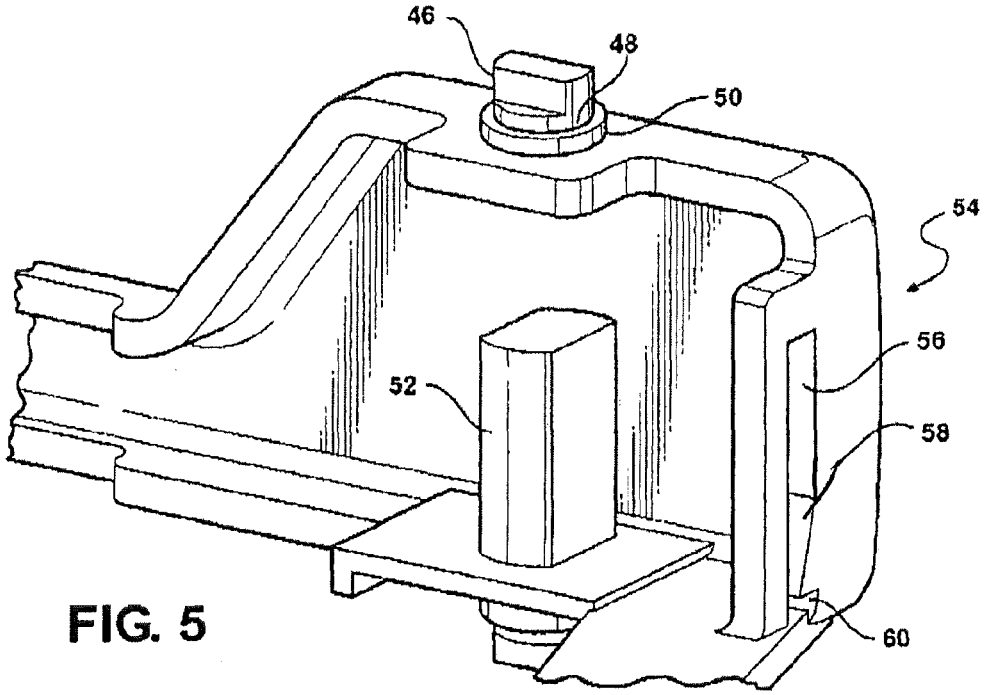
FIG. 5 is a B side-facing perspective view of a portion of the handle shown in FIG. 4.
Figure 6:
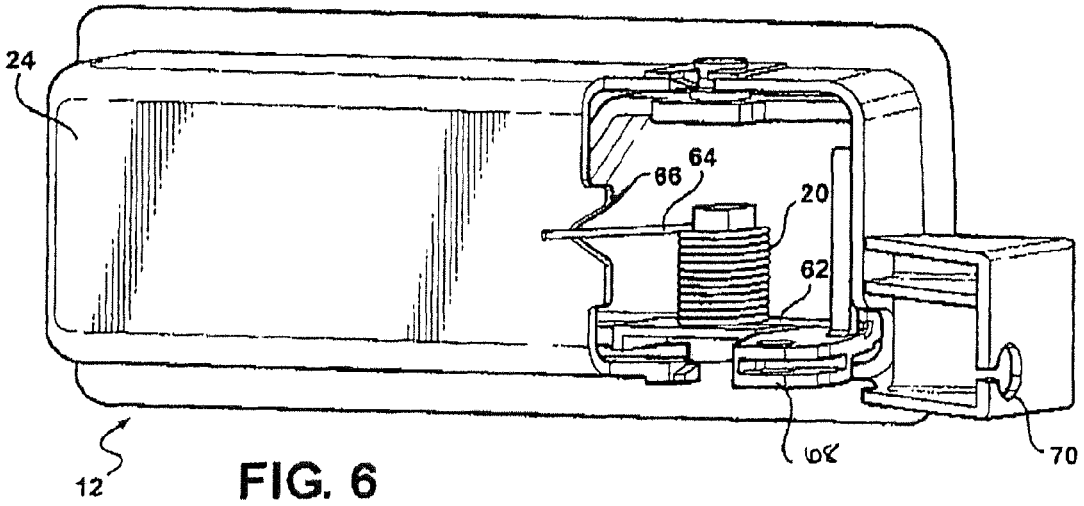
FIGS. 6 and 7 are perspective views of the handle assembly according to an alternative embodiment showing the handle of FIGS. 4 and 5 mounted to a backplate similar to the backplate shown in FIG. 3.

Referring now to FIGS. 4 and 5, an alternative embodiment or configuration of the handle 16 is shown in greater detail. The handle 16 includes an integrally-formed handle body portion 40 and a narrower handle arm portion 42 adapted for grasping. A pair of integrally-formed pins 44 form the pivot axis for the handle 16. When handle 16 is inserted into the handle aperture 26, the pins 44 are guided into the pivot mounts 32. Each of the pins 44 includes a guide section having a pair of D-flat portions 46, a cylindrical pivot segment or surface 48 and a bearing surface 50. The D-flat portions 46 help locate the handle 16 in an "assembly" position prior to installation and to the guide handle 16 into the void 36 during manual assembly of the handle 16 into the backplate 12. The D-flat portions 46 are sized to fit within the assembly slot 38 when the handle 16 is inserted generally perpendicular into the handle aperture 26 and to retain the handle 16 when the handle is non-perpendicular relative to the backplate 12. Each pivot surface 48 interfaces with the bezel 39 to allow the handle 16 to rotate. Likewise, each bearing surface 50 interfaces with the bezel 39 to maintain the spacing between the backplate 12 and the body portion 40.

Along the B-side facing surface of the handle 16 there is provided a handle spring post 52 and a spring locator 54. The spring locator 54 includes a retention slot 56 having a retention ramp 58 and a retention pocket 60. The torsion spring 20 is pivotally mounted around the handle spring post 52. A first arm 62 on the torsion spring 20 is retained within the retention pocket 60. A second arm 64 on the torsion spring 20 abuts against a groove 66 in the concave region 24 of the backplate 12. Preferably, a pair of integrally-formed spring locator tabs 67 helps to locate and retain the second arm 64 (FIG. 3). During, assembly, the handle spring post 52 helps locate and support the torsion spring 20. After the torsion spring 20 is mounted to the handle spring post 52, the first arm 62 is inserted into the retention slot 56 and pushed along the retention ramp 58 to snap into the retention pocket 60, which retains the first arm 62 during both assembly and operation of the handle assembly 10.

The handle further includes an arm 68 on the B-side of the handle body portion 40. The arm 68 extends inwardly and the end of the arm 68 is adapted to receive the end of a door cable or cable rod (neither shown) in order to actuate a door latch (also not shown). Preferably a cable guide 70 is provided on the inside of the backplate 12 in order to help route the cable or rod. A flared portion of the bumper 18 is seated within a bumper aperture 72 located along an edge of the handle body portion 40. A flared second end portion 74 of the bumper 18 abuts against a bumper ramp 76 integrally formed in the backplate 12, and provides a dampening effect when the handle 16 returns to the resting position.

During assembly, the handle 16 is preloaded with the torsion spring 20 and the bumper 18 prior to mounting the handle 16 to backplate 12. An assembler locates the torsion spring 20 around the handle spring post 52, and the handle spring post 52 helps to retain the torsion spring 20 during subsequent assembly steps. The handler next places the first arm 62 of the spring 20 into the retention slot 56. By forcing the first arm 62 against the incline of the retention ramp 58, the first arm 62 is loaded so that it snaps into the retention pocket 60. Once located within the retention pocket 60, the first arm 62 remains in place for future assembly steps. Preferably, the bumper 18 is seated within the bumper aperture 72 prior to mounting the handle 16 to the backplate 12.

Next, the handle 16 is inserted through the handle aperture 26 from the B-side of the backplate 12 at an angle substantially perpendicular to the cover plat 12. The pivot pins 44 are aligned adjacent to the pivot mounts 32 and are placed up against the curved surfaces 41 to help locate the handle 16. The assembler can now press the handle 16 into the pivot mounts 32 as the D-flat portions 46 of the pins 44 slide through the assembly slots 38 and into the voids 36 where the pins 44 are snap-locked in place. The assembly ramps 43 ease the snap-in insertion of the handle 16 and function to retain the handle after insertion. As the pins 44 move through the assembly slots 38, the second arm 64 on the torsion spring 20 is compressed against the groove 66, thereby placing the torsion spring 20 under load. Once the pins 44 enter the voids 38, the assembler releases the handle 16, and the torsion spring 20 pivots the handle 16 into its un-actuated position. During operation, the handle 16 is pivoted by an operator between its un-actuated and actuated positions. As with assembly, the pivoting handle 16 acts to load the torsion spring 20 so that it returns the handle 16 to its un-actuated position upon release. As the handle 16 moves into its actuated position, the load on the torsion spring 20 increases to prevent the handle 16 from moving fully perpendicular to the backplate 12.

Those skilled in the art will understand that a variety of modifications may be made to the embodiments described herein without departing from the spirit of the invention. For example, pivot mounts 32 may include extended and reinforced walls to provide a greater resiliency against the twisting of the handle. Alternatively, handle assembly 10 may be adapted to other types of closures, such as hatches, lift and tail gates, glove compartment boxes or exterior facing door handle assemblies.

The invention claimed is:

1. A handle assembly for a vehicle door, comprising:

a back plate mountable to the vehicle door, the back plate including a recessed region, a web portion surrounding at least a portion of the recessed region, and a handle aperture disposed along the recessed region of the back plate;

the web portion of the back plate defining a pair of pivot mounts on opposites sides of the handle aperture, each of the pivot mounts including an assembly slot interconnecting the handle aperture to a void, the assembly slots being narrower than the voids to retain a pair of pivot pins in the voids;

a handle having a portion disposed in the handle aperture of the back plate when the handle is mounted to the back plate, the handle including the pivot pins each disposed in a corresponding one of the voids of the web portion for mounting the handle to the back plate and allowing the handle to pivot between an un-actuated position and an actuated position;

the portion of the handle further including a spring post disposed in the handle aperture, a retention slot extending parallel to the spring post, a retention pocket open to the handle aperture and extending perpendicularly to the retention slot, and a retention ramp extending at an angle from the retention slot to the retention pocket; and a spring including a coiled segment disposed around the spring post of the portion of the handle, the spring is compressed between the handle and the back plate, the spring biasing the handle toward the un-actuated position, the spring extending from a first arm disposed in the retention slot of the portion of the handle to a second arm engaging the back plate, wherein the first and second arms of the spring extend perpendicularly to the spring post.

2. The handle assembly of claim 1, wherein the recessed region of the back plate includes a groove facing the handle aperture;

the spring includes a coiled segment extending between the first arm and the second arm, the second arm is disposed in the groove of the back plate, and the first and second arms of the spring are compressed between the groove of the back plate and the retention pocket of the handle to place the spring under load.

3. The handle assembly of claim 2, wherein the retention slot is narrower than the retention pocket.

4. The handle assembly of claim 1, including an assembly ramp disposed along each of the assembly slots.

5. The handle assembly of claim 1, wherein each of the pivot pins includes a D-flat portion for insertion though a corresponding one of the assembly slots and into the associated void when the handle is at a first angle relative to the back plate and retaining the pivot pins in the voids when the handle is at a second angle relative to the back plate.

6. The handle assembly of claim 1, wherein the portion of the handle located in the handle aperture includes a bumper aperture;

the web portion of the back plate includes a bumper ramp aligned with the bumper aperture; and further comprising:

a bumper abutting the bumper ramp and extending through the bumper aperture for providing a damping effect when the handle pivots from the actuated position to the un-actuated position.

7. A handle assembly for a vehicle door, comprising:

a back plate mountable to the vehicle door, the back plate including a handle aperture and a pair of voids disposed on opposite sides of the handle aperture;

the back plate further including a pair of assembly slots interconnecting the handle aperture to the voids with each assembly slot associated with a corresponding one of the voids, and the assembly slots being narrower than the voids to retain a pivot pin in each of the voids;

a handle having a portion disposed in the handle aperture when the handle is mounted to the back plate, and including the pair of pivot pins, each disposed in a corresponding one of the voids, a spring post, and a spring locator;

the spring locator including a retention pocket open to the handle aperture, a retention slot extending parallel to the spring post and perpendicularly to the retention pocket, and a retention ramp extending at an angle from the retention slot to the retention pocket;

a torsion spring including a coiled segment disposed around the spring post of the handle and extending between first and second arms, the first arm of the torsion spring being retained in the retention pocket of the handle, the second arm of the torsion spring engaging the back plate adjacent the handle aperture to place the torsion spring under load and biasing the handle to an un-actuated position, and wherein the first and second arms of the torsion spring extend perpendicularly to the spring post.

8. The handle assembly of claim 7, wherein the retention slot is narrower than the retention pocket.

9. The handle assembly of claim 7, wherein the back plate further includes a groove adjacent the handle aperture for retaining the second arm of the torsion spring therein.

10. The handle assembly of claim 9, wherein the back plate further includes a pair of locator tabs aligned with the groove for locating the second arm of the torsion spring.

11. The handle assembly of claim 7, wherein the portion of the handle located in the handle aperture includes a bumper aperture;

the back plate includes a web portion extending along at least a portion of the recessed region including at least a portion of the handle aperture, the web portion of the back plate presenting the pairs of assembly slots and voids and a bumper ramp aligned with the bumper aperture; and further comprising:

a bumper abutting the bumper ramp of the back plate and extending through the bumper aperture of the handle for providing a damping effect when the handle pivots from an actuated position to the un-actuated position.

12. The handle assembly of claim 7, wherein the portion of the handle includes a handle body portion disposed in the handle aperture;

each of the pivot pins extends from the handle body portion and is pivotally retained in a corresponding one of the voids, and each of the pivot pins includes a D-flat portion aligned with the handle body portion and sized to fit within the assembly slot associated with each of the voids when the handle is inserted at a first angle relative to the back plate and retain the pivot pin in their respective voids when the handle is at a second angle relative to the back plate.

13. A handle assembly for a vehicle door, comprising:

a back plate mountable to the vehicle door, the back plate including a handle aperture and a pair of pivot mounts, each pivot mount including an assembly slot extending from the handle aperture to a void, the assembly slot being narrower than the void;

a handle including a handle body portion disposed in the handle aperture and a pair of pivot pins each extending from the handle body portion for mounting the handle to the back plate and each pivotally retained in a corresponding one of the voids, each of the pivot pins including a D-flat portion aligned with the handle body portion and sized to fit within a corresponding one of the assembly slots when the handle is inserted at a first angle relative to the back plate and retain each of the pivot pins in their respective voids when the handle is at a second angle relative to the back plate;

the handle body portion further including a spring post disposed in the handle aperture when the handle is mounted to the back plate, a retention slot extending parallel to the spring post, a retention pocket open to the handle aperture and extending perpendicularly to the retention slot, and a retention ramp extending at an angle from the retention slot to the retention pocket; and a torsion spring including a coiled section disposed around the spring post of the handle, the spring extending from a first arm disposed in the retention pocket of the handle body portion to a second arm engaging the back plate, the torsion spring biasing the handle toward an un-actuated position wherein the D-flat portions of the pivot pins are at the second angle relative to the back plate, and, wherein the first and second arms of the torsion spring extend perpendicularly to the spring post.

14. The handle assembly of claim 13, wherein each D-flat portion is aligned parallel to the handle body portion, the handle body portion is perpendicular to the back plate at the first angle, and the handle body portion is non-perpendicular to the back plate at the second angle.

15. The handle assembly of claim 13, wherein each of the voids of the pivot mounts have a cylindrical shape, and each of the D-flat portions are disposed on a bearing surface having a cylindrical shape.

16. The handle assembly of claim 13, wherein each of the pivot mounts includes an assembly ramp disposed along the assembly slot.

17. The handle assembly of claim 13, wherein the back plate includes a groove adjacent the handle aperture for retaining the second arm of the torsion spring.

18. The handle assembly of claim 13, wherein the handle body portion includes a bumper aperture;

the back plate includes a bumper ramp aligned with the bumper aperture; and further comprising:

a bumper abutting the bumper ramp of the back plate and extending through the bumper aperture of the handle for providing a damping effect when the handle pivots from an actuated position to the un-actuated position.

* * * * *